US005710393A

United States Patent [19]

Smith et al.

[11] Patent Number: 5,710,393

[45] Date of Patent: Jan. 20, 1998

[54] MODULAR ARRAY TERMINATION FOR MULTICONDUCTOR ELECTRICAL CABLES

[75] Inventors: Daniel B. Smith, Beaverton; Dan A. Vance, Portland, both of Oreg.

[73] Assignee: The Whitaker Corporation, Wilmington, Del.

[21] Appl. No.: 442,729

[22] Filed: May 17, 1995

[51] Int. Cl.[6] ..... H01R 23/06

[52] U.S. Cl. ..... 174/74 R; 29/828; 174/201

[58] Field of Search ..... 174/117 R, 117 F, 174/117 AS, 117 A, 268, 261, 71 R, 74 R; 439/63, 88; 29/828, 843, 884

[56] References Cited

U.S. PATENT DOCUMENTS

| | | | |
|---|---|---|---|
| 2,670,530 | 3/1954 | Regnier | 29/155.55 X |
| 3,794,522 | 2/1974 | Mueller et al. | 134/1 X |
| 4,085,502 | 4/1978 | Ostman | 29/629 X |
| 4,697,339 | 10/1987 | Verhoeven | 29/828 |
| 5,206,462 | 4/1993 | Iura et al. | 174/117 F |
| 5,281,762 | 1/1994 | Long et al. | 174/78 X |
| 5,347,711 | 9/1994 | Wheatcraft et al. | 29/843 |
| 5,381,795 | 1/1995 | Nordgren et al. | 128/663.01 |
| 5,387,764 | 2/1995 | Blom et al. | 174/261 |
| 5,482,047 | 1/1996 | Nordgren et al. | 128/662.03 |

FOREIGN PATENT DOCUMENTS

4415387A1 11/1994 Germany .

*Primary Examiner*—Kristine L. Kincaid
*Assistant Examiner*—Chau N. Nguyen

[57] ABSTRACT

A multiconductor cable (10) including a large number of coaxial conductor pairs (16), with the coaxial conductor pairs arranged in groups (14) each including several of the coaxial conductor pairs arranged in a required order as a modular array (18) with each of the conductor pairs of each array being held in a required position with respect to the others and supported with a portion of each central conductor (54) and each shield conductor (47) exposed at a predetermined position, for connection of the array to a corresponding array (28) of terminal pads (24, 26) on a circuit board (30) or the like. Each array includes support bodies (32, 34) of flexible dielectric sheet material adhesively attached to the coaxial conductor pairs to support them in the required positions. Apertures (70, 76) are defined in the sheet material to expose the conductors for simultaneous soldering to, or unsoldering from, the terminal pads (24, 26), without removal of the support bodies (32, 34) from the coaxial conductors.

8 Claims, 3 Drawing Sheets

MODULAR ARRAY TERMINATION FOR MULTICONDUCTOR ELECTRICAL CABLES

FIELD OF THE INVENTION

The present invention relates to holding the terminal portions of multiconductor electrical signal cables ready for connection to respective portions of electrical circuits, and relates particularly to a device for holding several very small coaxial conductor pairs included in such a cable in a closely-spaced array ready for connection to a corresponding array of closely spaced terminal pads.

BACKGROUND OF THE INVENTION

Multiconductor cables containing hundreds or even thousands of very small conductors or coaxial conductor pairs are utilized to interconnect separate portions of complex electronic circuits as, for example, to connect small, relatively portable sensing devices to larger, less portable, circuits as in certain medical ultrasound imaging devices. It is usually important to minimize the size of such cables and the portable devices to which they are connected, in order to make the cables easy to handle and the portable devices convenient to use.

One way to hold several conductors of a multiconductor cable arranged in the required order and at the required pitch for connection to an array of terminals in a circuit to which such a cable is to be connected is shown in Wheatcraft et al. U.S. Pat. No. 5,347,711. The central conductors of coaxial pairs are individually connected electrically to test contacts of a transfer frame disclosed by Wheatcraft et al., as by manually soldering each conductor separately to a respective contact which is part of the transfer frame. Attachment of such a transfer frame to a cable is thus a very time-consuming part of the manufacture and preparation of a cable. While such a transfer frame provides significant time savings in connecting a cable to a circuit, once such a cable is connected to the circuit for which it is intended the transfer frame disclosed by Wheatcraft et al. is cut free from the cable.

All too frequently, however, it is necessary to disconnect a cable from an electrical circuit, as when a defective portable device to which such a cable is connected has to be replaced. In the past this has required the installation of another such transfer frame on the cable, then, to arrange the conductors to facilitate connection of the cable to another circuit. It is desired, then, to be able to disconnect and reconnect the many conductors or conductor pairs of a multiconductor cable, repeatedly if necessary, without each time having to spend a great deal of time to connect a transfer frame. It is also preferred to connect or disconnect such an array of conductors or conductor pairs to and from an array of terminal pads by mass reflow soldering and unsoldering techniques.

In use of the Wheatcraft et al. transfer frame a factor limiting use of simultaneous soldering, or mass termination, techniques is that unless it is first tinned, cutting the outer, or shield, conductor of a coaxial pair allows the ends of the several tiny wires of a served shield to splay out from the dielectric layer, so that a heating element can damage the dielectric material and yet may not transmit enough heat to melt solder as required for simultaneous mass solder reflow termination of the shield conductors to a circuit to which the cable is being connected. This is even a more serious problem if unsoldering is required since melting the solder to disconnect a shield conductor frees its tiny wires to splay, even if they had been tinned previously.

It is known to connect small coaxial conductor pairs of a multiconductor cable to an array of closely-spaced terminal pads through a short flex circuit, to which the conductors or coaxial conductor pairs of a cable are individually connected, as taught by Blom et al., U.S. Pat. No. 5,387,764. Printed circuit traces which are part of such a flex circuit span an aperture, spaced at the required pitch, where the conductive material of the traces is exposed for connection to a corresponding array of terminal pads of the electronic circuit to which the cable's conductors are to be connected. The printed circuit traces spanning the aperture can be soldered to a terminal pad array as a group by mass solder reflow termination techniques. The printed circuit traces spanning an aperture in such a flex circuit, however, are typically wider than the diameter of the corresponding center conductor wires of coaxial conductor pairs thus to be connected, and are therefore located closer to each other on the flex circuit than would be the case for the wires of the coaxial conductors themselves, spaced at the same pitch. As a result, misalignment when connecting an array of such printed circuit traces to an array of terminal pads is somewhat more likely than when connecting the center conductor wires at the same pitch to such terminal pads. Use of such flex circuit connectors thus may also result in more signal interference among the traces than is desired, or may require wider spacing than is desired, to avoid such interference.

The printed circuit traces spanning the apertures in such flex circuit connector devices are typically much more fragile than the individual center conductor wires of the coaxial conductor pairs which can be placed at the same pitch. Such flex circuit connectors, therefore, can withstand being disconnected from a circuit only a very small number of times, and special care must be taken in connecting or disconnecting such a flex circuit arrangement, in order not to damage the printed circuit traces or to unsolder the individual coaxial conductor pairs from the flex circuit. Additionally, use of such flex circuits necessarily results in an additional junction in each conductor, adding costs and reducing reliability.

What is desired, then, is an improved device for holding the terminal portions of several coaxial conductor pairs in an array which will permit simultaneous mass solder reflow termination of such an array of coaxial conductor pairs to a corresponding array of closely-spaced terminal pads, which will allow a cable including many conductors to be connected to and disconnected from such an array of terminal pads more quickly and easily than has previously been possible, which will allow several connections and disconnections before it becomes necessary to rework the cable, and which will assure that the individual conductors of a cable are accurately aligned with the respective terminal pads for connection thereto by mass reflow soldering techniques.

SUMMARY OF THE INVENTION

The present invention provides a device which overcomes the aforementioned shortcomings and disadvantages of the prior art by providing a modular array structure for holding the terminal portions of several coaxial conductor pairs of a multiconductor electrical cable, and thus provides a multiconductor cable including at least one such array of terminal portions of respective coaxial conductor pairs, arranged for accurate mass reflow connection simultaneously to several terminal pads of a corresponding array. For each coaxial conductor pair of a modular array according to the present invention a length of a shield conductor is exposed for electrical connection to a respective terminal pad, and a short tube, such as a short length of a tubular jacket portion of the coaxial pair, is located so as to cover and retain a distal portion of such a shield conductor. This short length of tubular jacket material keeps the wires of the shield conductor in place around the dielectric material separating the shield conductor from the central conductor, of which a portion is also exposed to be connected to a respective terminal pad. The several coaxial conductor pairs of the array are held together at a required pitch, corresponding to the spacing of terminal pads to which the array is to be electrically connected, by support members which can be adhesively connected to the arrayed coaxial conductor pairs, preferably at three locations spaced apart longitudinally along each conductor pair.

In one embodiment of the invention a pair of support bodies of thin flexible sheet dielectric material are attached to the array of coaxial conductor pairs and to each other by an adhesive. Both the flexible dielectric material and the adhesive are able to withstand the temperature of soldering, to hold the pairs properly aligned longitudinally with each other and spaced at the desired pitch. Portions of the shield and central conductors of the coaxial pairs are exposed and accessible for soldering to terminal pads through openings defined by the support bodies between the portions of the support bodies which interconnect and establish the pitch between the coaxial conductor pairs. Since the support bodies are attached by an adhesive able to withstand soldering temperatures, the modular arrays can be soldered to or unsoldered from an array of terminal pads several times.

In one embodiment of the invention, the support bodies include locator devices, such as locator pin or registration holes defined in predetermined locations with respect to the coaxial conductors, to facilitate alignment of each array of coaxial conductor pairs with an array of terminal pads on a circuit to which the cable is to be connected.

In one embodiment of the invention the exposed portions of the shield and central conductors are tinned, the adhered tinning helping further to preserve the mechanical integrity of the exposed portion of the shield conductor.

The support bodies of the device of the present invention hold together the terminal portions of the coaxial conductor pairs as a modular array, with all the terminal portions aligned with one another and spaced at the desired pitch, with the shield conductors held close to the layer of dielectric material by the short length of tubular jacket material. The modular array of the present invention makes it practical, then, to solder the entire group of central conductors simultaneously to their respective terminal pads, and likewise, to solder all of the shield conductors simultaneously to the shield bus terminal or to respective individual shield conductor terminals, by mass solder reflow termination techniques such as simultaneously reflowing solder or solder preforms.

The foregoing and other objectives, features, and advantages of the invention will be more readily understood upon consideration of the following detailed description of the invention, taken in conjunction with the accompanying drawings.

DESCRIPTION OF THE DRAWINGS

FIG. 4 shows a coaxial conductor pair of which a short terminal portion of a tubular outer jacket and an outer, or shield conductor have been cut.

FIG. 5 shows the coaxial conductor pair shown in FIG. 4 after the terminal portions of the jacket and shield have been moved a short distance.

FIG. 6 shows the coaxial conductor pair shown in FIG. 5 after the dielectric layer has also been cut and separated portions of the tubular jacket, shield conductor, and dielectric layer have been moved longitudinally along the central conductor to expose a portion of it.

FIG. 7 shows the coaxial conductor pair with a short length of the tubular jacket moved to expose a portion of the shield conductor.

DETAILED DESCRIPTION

Figure 1:
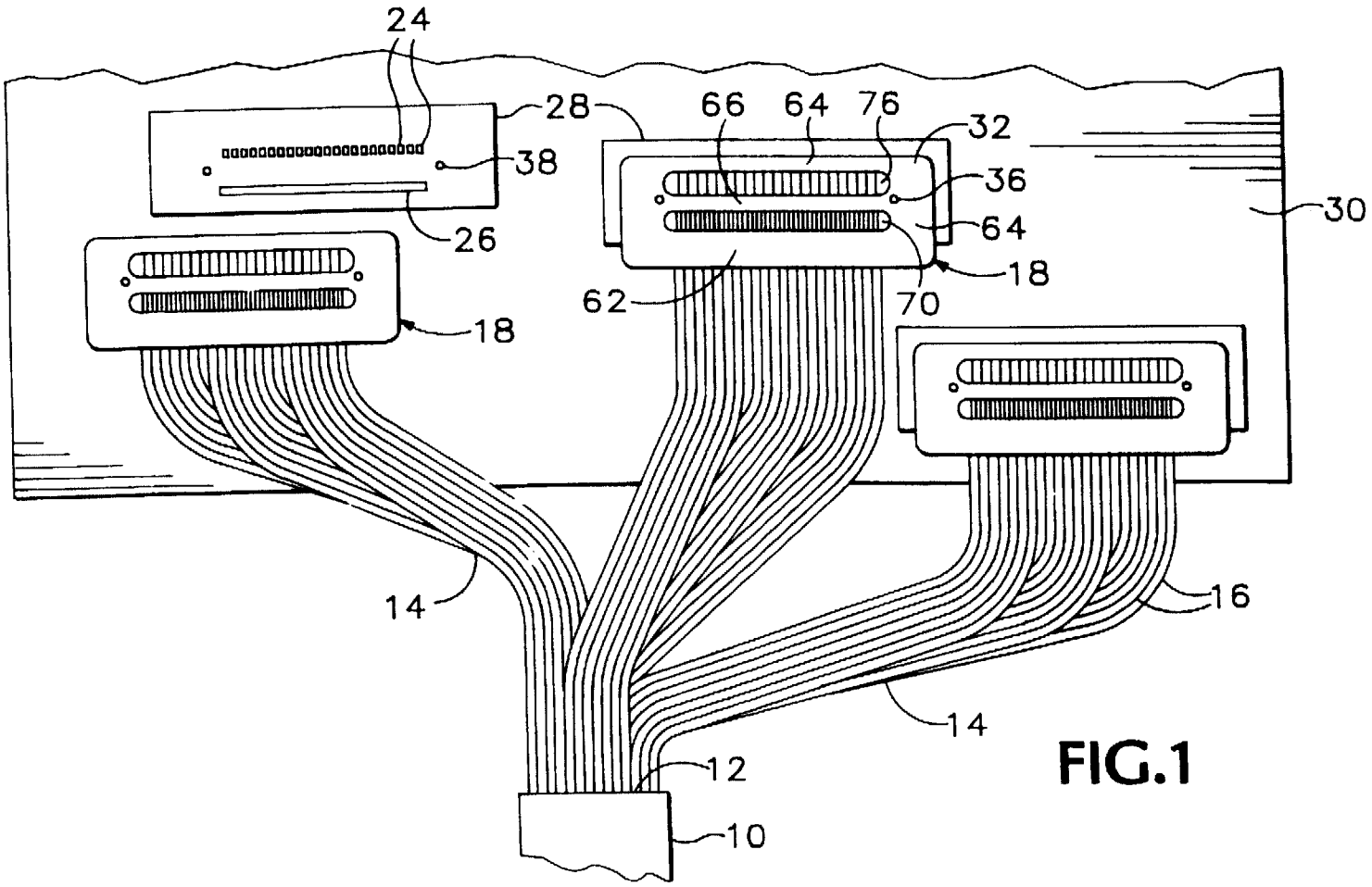
FIG. 1 is a plan view of a portion of a multiconductor electrical cable including many individual coaxial conductor pairs, arranged in three modular arrays according to the invention, with two of the modular arrays connected to respective arrays of terminal pads on a circuit board.

Referring now to the drawings which form a part of the disclosure herein, as shown in FIG. 1 a multiconductor cable 10 includes a tubular cover 12 surrounding a large number of coaxial conductor pairs which extend from the end of the cover 12 in the form of three bundles 14. Each bundle 14 includes several coaxial conductor pairs 16, and the bundles 14 may, if desired, be bound at spaced intervals to keep the several conductor pairs 16 of each bundle 14 grouped together conveniently.

The conductor pairs 16 of each of the bundles 14 end together in a respective modular array 18 in which a terminal portion 20 of each of the conductor pairs 16 is aligned and held in a desired position with respect to each of the other terminal portions 20 in the particular modular array 18. Thus, in each of the modular arrays 18 each of the terminal portions 20 is held in the proper position for connection to the corresponding one of an array of signal conductor terminal pads 24 and a shield conductor terminal pad 26 in a terminal array 28 located on a circuit board 30 forming part of a circuit to which the cable 10 is connected electrically.

Figure 2:
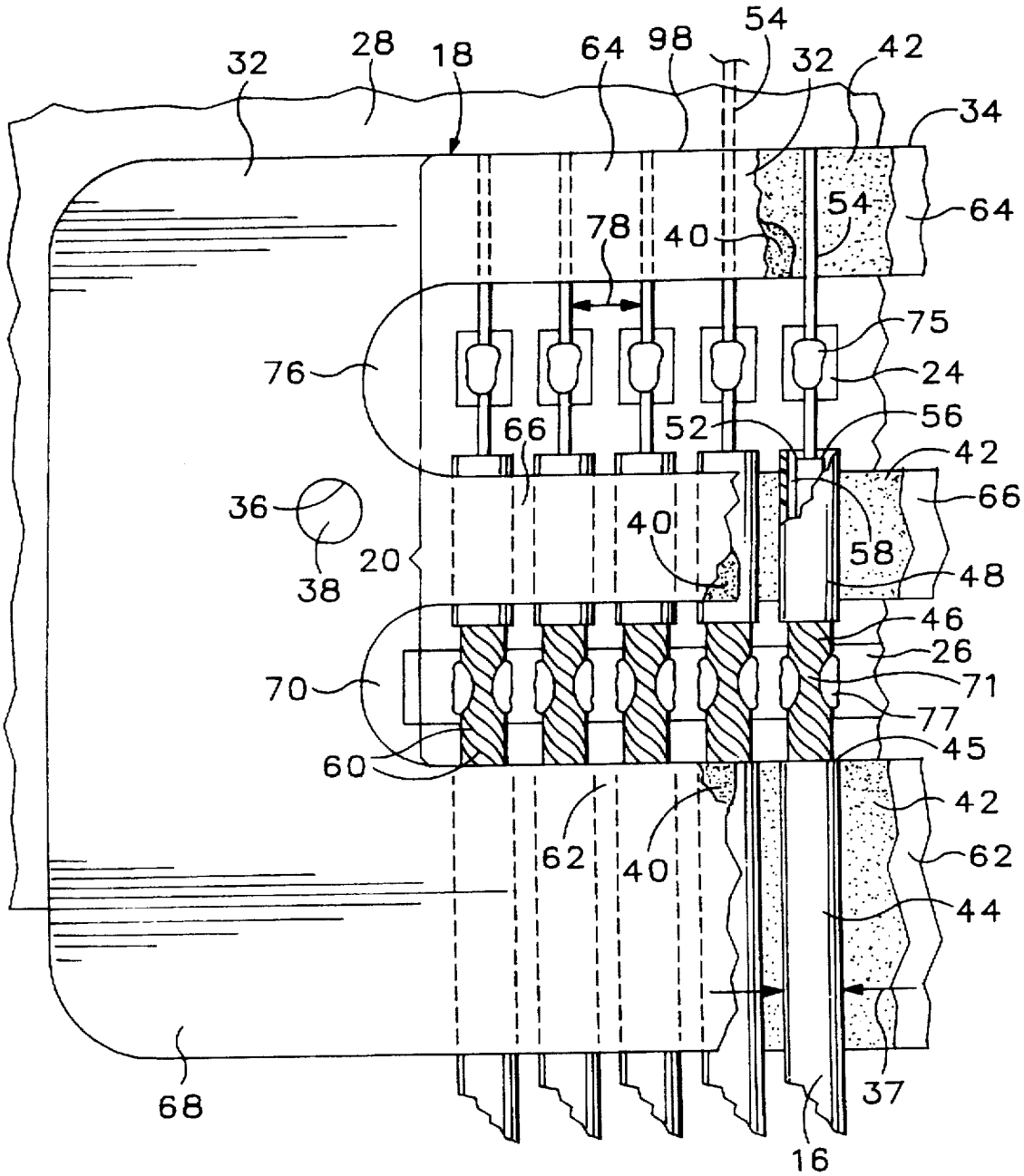
FIG. 2 is a partially cut-away plan view of one of the modular coaxial conductor arrays shown in FIG. 1, at an enlarged scale.
Figures 3, 4, 5, 6, 7:
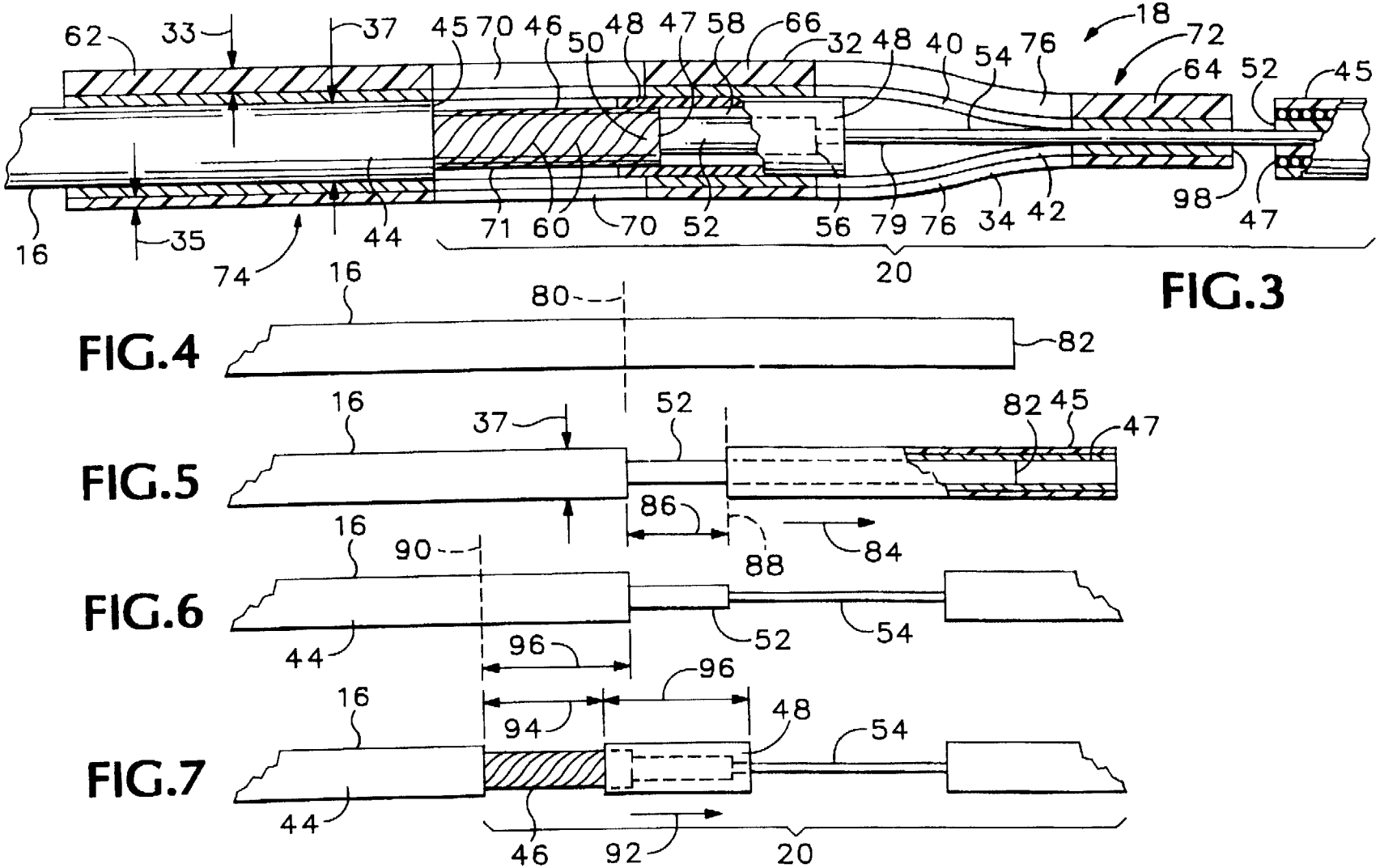
FIG. 3 is a sectional view of a modular array of coaxial conductor pairs such as the one shown in FIG. 2, taken in the direction indicated by line 3—3, at an enlarged scale.
FIGS. 4–7 show successive steps of preparation of a coaxial conductor pair for inclusion in a modular array according to the invention; in particular.

Referring now also to FIGS. 2 and 3, it will be seen that the modular array 18 includes a pair of support bodies of strong flexible dielectric sheet material such as a polyimide sheet material available from the Allied Signal Corporation of Hoosick, N.Y. An upper support body 32 may be of thicker sheet material than the lower support body 34, which is preferably thinner in order to facilitate soldering the individual conductors of the conductor pairs 16 to the terminal pads 24 and 26 as will be explained below. For example, the upper support body 32 may be of polyimide having a thickness 33 of 5 mils, while the lower support body 34 may have a thickness 35 of 1.5 mils, in an array of coaxial conductor pairs 16 each having a diameter 37 of 0.020 inch, spaced at a pitch 78 of 0.025 inch. The upper and lower support bodies 32, 34 are of similar shape and are mated together aligned with each other. They define a pair of registration holes 36 extending through both to be aligned with corresponding locating devices such as registration holes 38 defined in the circuit board 30 to receive locating pins temporarily during attachment of a modular array 18 to a terminal array 28.

A layer 40 of adhesive 40 is provided on the lower side of the upper support body 32 and a similar layer 42 of adhesive material is present on the upper surface of the lower support body 34, attaching the upper and lower support bodies 32, 34 to each other and to each of the coaxial conductor pairs 16 which is a part of the modular array 18. The adhesive material of the layers 40 and 42 is preferably a pressure-sensitive polymeric silicone adhesive able to withstand temperatures exceeding those encountered in soldering and unsoldering. For example, a satisfactory silicone adhesive is available, pre-applied as a thin layer to the previously described polyimide sheet material available from Allied Signal Corporation of Hoosick, N.Y.

Each of the coaxial conductor pairs 16 of a modular array 18 includes a main portion leading from the array 18 as a part of the respective bundle 14 and thence into the main body of the cable 10. Thus, there is a main jacket portion 44 of an outer insulating jacket 45 of tubular material, and the terminal portion 20 of each of the conductor pairs 16 extends distally away from the main jacket portion 44. The terminal portion 20 includes a short length 46 of an outer or a shield conductor 47 extending from the main jacket portion 44 of the jacket 45. A short length 48 of the tubular jacket material surrounds a distal portion 50 of the extending short length 46 of the shield conductor 47. A dielectric layer 52 extends further from the main body portion 44 of the jacket, beyond the distal portion 50 of the short length 46 of the shield conductor 47 and within the short length 48 of tubular jacket material, and an exposed portion of a central conductor 54 extends beyond the distal end 56 of the dielectric layer 52. An annular air gap 58 thus remains between the short length 48 of tubular jacket material and the portion of the dielectric layer 52 extending beyond the distal portion 50 of the shield conductor 46. The shield conductor 46 is thus kept spaced apart from and insulated from electrical contact with the central conductor 54.

Since the shield conductor 47 is a layer of several small wires 60 served, that is, wrapped helically side by side on the dielectric layer 52, the short length 48 of jacket material surrounding the distal portion 50 of the shield 47 keeps the wires 60 close together and tightly arranged about the dielectric layer 52, preventing them from splaying apart.

With each of the coaxial conductor pairs 16 held similarly aligned and parallel with each other at the required pitch 78 to correspond with the spacing of the terminal pads 24, the upper and lower support bodies 32 and 34 are attached to all of the conductor pairs 16 by the adhesive layers 40 and 42, thus defining a top side 72 and a bottom side 74 of the modular array 18.

The upper and lower support bodies 32 and 34 each include a first or rear support member in the form of a transversely extending strip 62, a second or front support member in the form of a transversely extending strip 64, and a third or central support member in the form of a transversely extending strip 66. The transversely extending strips 62, 64 and 66 are all held at the required distances from each other and are interconnected with each other by a pair of spacer members in the form of side portions 68 which define the locator holes 36. A transverse aperture 70 is defined between the rear transverse support strip 62 and the central transverse support strip 66, exposing a respective termination portion 71 of each of the short lengths 46 of the shield conductor on both the top side 72 and the bottom side 74 of the modular array 18. A transverse aperture 76 defined between the front transverse support strip 64 and the central transverse support strip 66 similarly exposes a termination portion 79 of each of the central conductors 54 at both the top side 72 and the bottom side 74 of the modular array 18.

The portions of the adhesive layers 40, 42 on the transverse front support member strips 64 of the upper and lower support bodies 32 and 34 engage each of the central conductors 54 and also adhere to each other between the central conductors 54, keeping the central conductors 54 properly spaced apart from one another at the required pitch 78. Similarly, the adhesive layers 40, 42 of the transverse rear support member strips 62 hold the main body portions 44 of the insulating jackets of the conductor pairs 16 closely spaced at the same pitch 78, and the transverse central support member strips 66 are adhered to the short lengths 48 of tubular jacket material and similarly maintain their positions at the same pitch 78. The upper and lower support bodies 32 and 34 thus keep the terminal portions 20 of all of the conductor pairs 16 aligned with one another and spaced apart from one another at the required pitch 78.

In connecting the cable 10 to the circuit board 30, each of the modular arrays 18 is aligned properly with its respective terminal array 28, by the use of the registration holes 36 in the support bodies 32 and 34 and the registration holes 38 at each terminal array 28, thereby aligning each of the central conductors 54 with the appropriate terminal pad 24 and aligning an exposed portion of the short length 46 of each shield conductor 47 with the common terminal pad 26, or with the appropriate individual shield terminal pad (not shown) of a terminal array which has individual shield terminal pads. With the parts which are to be connected thus being aligned properly, appropriate heater bars and solder preforms may be used to solder the termination portions 79 of all of the central conductors simultaneously as at 75 and to solder all of the exposed termination portions 71 of the shield conductors 47 simultaneously as at 77 to make all of the required electrical interconnections; because of its small thickness, the lower support body 34 offers no significant interference to use of such mass solder reflow termination methods to connect the conductor pairs 16 of the modular array 18.

If it should become necessary to disconnect the modular array 18 from a terminal array 28, all of the connections can be heated simultaneously in a similar manner to release each of the central conductors 54 and shield conductors 47 from the respective terminal pads 24 or 26, and the upper and lower support bodies 32 and 34 of the modular array 18 will continue to maintain the alignment and pitch among all of the conductor pairs 16 of the modular array 18. The cable 10 can thus be disconnected from a defective circuit and can be connected to a replacement circuit without having to verify or re-establish the arrangement and spacing of the many coaxial conductor paris 16 as part of the task of connecting the cable 10 to a circuit.

In order to facilitate solder connection of the conductor pairs 16 to a terminal array 28, it may be desirable to tin the exposed portions of each of the central conductors 54 and of the short lengths 46 of the shield conductors 47 of the modular array 18. This can be accomplished simply by dipping the modular array 18, including the support bodies 32 and 34 into molten solder of the appropriate composition. Tinning the exposed conductor portions of the modular array 18 has the additional benefit that solder adhered to the exposed portion of the short length 46 of shield conductor 47 tends to reinforce the action of the short length 48 of tubular jacket material encircling the distal end portion 50 of each of the shield conductors 47. That is, the adhered tinning solder bridges any small gaps between the individual wires 60 of the shield conductor 47. This enhances the ability of the exposed portions of the shield conductors 47 to conduct heat from a heater bar to the terminal pad 26 and away from the dielectric layer 52 during the process of soldering the modular array 18 to the terminal array 28 and helps to protect the dielectric layer 52 from being damaged.

To prepare each of the conductor pairs 16 to be included in a modular array 18, as shown in FIG. 4, a first step is to cut through the tubular jacket 45 and the shield conductor 47 at a position such as the one indicated by broken line 80, close enough to the end 82 of the conductor pair 16 so that it is possible to slide the separated portions of the jacket 45 and shield 47 along the dielectric layer 52 to the position shown in FIG. 5.

With the jacket and shield conductor thus moved in the direction indicated by the arrow 84 in FIG. 5 a first distance of, for example, 0.050 inch (for a coaxial conductor pair 16 having a diameter 37 of 0.020 inch), the dielectric layer 52 is then cut at a distance 86 of, for example, 0.050 inch from the distal end 50 of the cut-back shield conductor 46. Conveniently, the dielectric layer can be cut at the position indicated by the broken line 88 adjacent the moved portions of the jacket 45 and shield 47. The separated portions of the jacket 45, shield 47, and dielectric layer 52 are then all moved a further distance such as 0.075 inch in the same direction along the central conductor 54 to expose the termination portion 79 of the central conductor 54 which will ultimately span the aperture 76 defined by the support bodies 32, 34.

Thereafter, the tubular jacket 45 is cut at the position indicated by the transverse broken line 90 in FIG. 6, without cutting through the shield conductor 47 at that location, and the short length 48 of tubular jacket material thus cut free is also moved in the direction of the arrow 91, through a distance 94, for example, 0.050 inch, that is less than the length 96 of the short length 48 of tubular jacket material by at least about 0.015 inch, and preferably 0.030 inch, so that a part of the short length 48 of tubular jacket material continues to surround the distal portion 50 of the shield conductor 46 as described above.

The moved portions of the jacket 45, shield 47, and dielectric layer 52 still surrounding the central conductor 54 can thereafter be placed in a suitable jig (not shown), if desired, to hold the terminal portion 20 of each coaxial conductor pair 16 in a respective required location while the upper support body 32 is attached to the coaxial conductor pairs and thereafter the lower support body 34 is mated to it to complete the modular array 18. Finally, when convenient, the central conductors 54 can be clipped close to the outer margin 98 of the front transverse support member 64 to complete preparation of the modular array 18.

It will be understood that an array of coaxial conductor sets of more than two coaxial conductors in each set could also be constructed to be similar to the array 18 of coaxial conductor pairs, with appropriately moved short lengths of dielectric material or jacket material used to retain the individual wires of served shield conductors and intermediate conductors, with an additional transverse aperture provided in a support body of such an array for each additional coaxial conductor of such a set.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A termination for coaxial cables comprising at least one insulating support body, multiple coaxial cables for electrical connection to a circuit, the coaxial cables being constructed, respectively, with central conductors within dielectric layers, conductive shields tightly arranged about the dielectric layers, and insulating jackets over the shields, main body portions of the jackets being attached to the support body, short lengths of the jackets being displaced from the main body portions of the jackets to reveal exposed portions of the shields, the short lengths of the jackets being attached to the support body to hold the exposed portions of the shields in positions for connection with the circuit, the short lengths of the jackets surrounding respective distal portions of the shields, the exposed portions of the shields being maintained tightly arranged about the dielectric layers by the short lengths of the jackets surrounding said distal portions of the shields, while being in said positions for connection with the circuit, and exposed portions of the central conductors extending beyond the short lengths of the jackets and being attached to the support body while being in positions for connection with the circuit.

2. A termination as recited in claim 1, and further comprising: projecting portions of the dielectric layers projecting beyond said distal portions of the shields, and annular air gaps between the short lengths of the jackets surrounding the projecting portions of the dielectric layers.

3. A termination as recited in claim 2, and further comprising: the short lengths of the jackets being longer than the projecting portions of the dielectric layer.

4. A termination as recited in claim 1, and further comprising: ends of the central conductors extending from the exposed portions of the central conductors, and separated portions of the dielectric layers surrounding said ends of the central conductors.

5. A termination as recited in claim 1, and further comprising: ends of the central conductors extending from the exposed portions of the central conductors, separated portions of the dielectric layers surrounding said ends of the central conductors, and the separated portions of the dielectric layers being surrounded by separated portions of the shields and separated portions of the jackets.

6. A termination as recited in claim 1, and further comprising: the exposed portions of the shields extending over an aperture through the support body, and the short lengths of the jackets being attached by the support body adjacent the aperture.

7. A termination as recited in claim 1, and further comprising: the main body portions of the jackets being attached to a support member strip on the support body.

8. A termination as recited in claim 1, and further comprising: the short lengths of the jackets being attached to a corresponding support member strip on the support body.

* * * * *